US007186184B2

(12) United States Patent
Buck

(10) Patent No.: US 7,186,184 B2
(45) Date of Patent: Mar. 6, 2007

(54) GOLF MAT AND PATTERN

(75) Inventor: Darin R. Buck, Matthews, NC (US)

(73) Assignee: Practice With The Pros, Inc., Matthews, NC (US)

( * ) Notice: Subject to any disclaimer, the term of this patent is extended or adjusted under 35 U.S.C. 154(b) by 303 days.

(21) Appl. No.: 10/820,769

(22) Filed: Apr. 9, 2004

(65) Prior Publication Data

US 2005/0227774 A1 Oct. 13, 2005

(51) Int. Cl.
*A63B 69/36* (2006.01)

(52) U.S. Cl. ..... 473/218; 473/270; 473/278

(58) Field of Classification Search ..... 473/150, 473/160, 218, 270, 278, 279; D21/792
See application file for complete search history.

(56) References Cited

U.S. PATENT DOCUMENTS

| | | | | |
|---|---|---|---|---|
| 1,484,390 | A | 2/1924 | Gibbs et al. | |
| 2,150,580 | A * | 3/1939 | Crowley | 473/273 |
| 2,707,638 | A | 5/1955 | Manley | |
| 3,350,101 | A | 10/1967 | Bishop et al. | |
| 4,000,905 | A | 1/1977 | Shirhall | |
| 4,023,810 | A * | 5/1977 | Lorang | 473/218 |
| 4,805,913 | A | 2/1989 | Bott | |
| 4,915,387 | A | 4/1990 | Baxstrom | |
| D308,087 | S | 5/1990 | Buffey | |
| 5,042,815 | A * | 8/1991 | Sutton | 473/218 |
| 5,071,130 | A | 12/1991 | Shofner | |
| 5,163,686 | A | 11/1992 | Bergman | |
| 5,275,570 | A * | 1/1994 | Hicks | 434/252 |
| 5,306,011 | A | 4/1994 | Perry | |
| 5,330,176 | A * | 7/1994 | Cagney, Jr. | 473/452 |
| 5,590,882 | A | 1/1997 | Todd | |
| 5,645,494 | A | 7/1997 | Dionne et al. | |
| 5,984,801 | A * | 11/1999 | Mason | 473/270 |
| 6,050,902 | A * | 4/2000 | McCrink, Jr. | 473/168 |
| 6,482,102 | B2 | 11/2002 | Grabowski | |
| 6,821,210 | B2 * | 11/2004 | Kallage, Jr. | 473/218 |

* cited by examiner

*Primary Examiner*—Nini F. Legesse
(74) *Attorney, Agent, or Firm*—Timothy R. Kroboth

(57) ABSTRACT

A golf teaching aid is disclosed. The beneficial golf mat and instructional pattern provide for precise, reproducible foot positioning and alignment, and a wide selection of precise, reproducible ball position options. The pattern may be variously displayed, for instance, on the playing surface of a golf mat or on the turf.

23 Claims, 3 Drawing Sheets

GOLF MAT AND PATTERN

FIELD OF THE INVENTION

This invention relates to a golf teaching aid.

BACKGROUND OF THE INVENTION

Golf is a game of distance and accuracy. There is a perfect golf swing for every golfer. Although numerous instructional and diagnostic golf mats and teaching aids are known, none has commercially replaced the traditional method of placing a club on the ground as a line of reference when hitting practice shots.

Accordingly, prior art golf mats as exemplified by U.S. Pat. No. 6,482,102 to Grabowski (Golf Learning and Guide is Mat), U.S. Pat. No. 5,645,494 to Dionne et al (Instructional Golf Mat), U.S. Pat. No. 5,590,882 to Todd (Diagnostic Apparatus for Golfclub Swing Practice), U.S. Pat. No. 5,306,011 to Perry (Golf Swing Training Device), U.S. Pat. No. 5,163,686 to Bergman (Practice Mat for Golfers), U.S. Pat. No. 5,071,130 to Shofner (Device for Perfecting a Golfer's Swing), U.S. Pat. No. 4,915,387 to Baxtrom (Golf Practice and Training Device), U.S. Pat. No. 4,805,913 to Bott (Device for Development Golf Ball Address Stance), U.S. Pat. No. 4,000,905 to Shirhall (Practice Mat for Golfers), U.S. Pat. No. 3,350,101 to Bishop et al (Golf Swing Aid), U.S. Pat. No. 2,707,638 to Manley (Individualized Golfer's Chart), U.S. Pat. No. 1,484,390 to Gibbs et al (Instruction Chart for Playing Golf), and Des. Pat. No. 308,087 to Buffey (Golf Practice Mat), are limited by various drawbacks that hinder commercial acceptability.

For instance, the Dionne et al, Bott, Bishop and Buffey mats each include a foot placement grid that can be confusing to use. In particular, it may be difficult for a golfer to achieve precise, reproducible foot positioning and alignment. Of this prior art, Bott appreciates that a sound golf ball address stance is the single most important aspect that a golfer can control, and further that muscle memory can be developed. Moreover, Bott somewhat solves the problem with his foot placement grid by using removably attachable foot silhouettes. However, such a solution is not without drawbacks, and in addition, the Bott mat is limited by a single target line for sighting a target.

Furthermore, ball position in a golfer's stance is personal and will vary depending upon factors including club selection and objective. To provide for reproducible ball positioning, Bott relies upon a removably attachable ball silhouette. Again, such an approach is not without drawbacks.

There therefore continues to be a significant need for an improved instructional and diagnostic golf teaching aid, in particular so that a perfect golf swing becomes a matter of feel. In particular, precise and reproducible foot positioning and alignment are necessary, as well as a wide selection of precise, reproducible ball position options.

SUMMARY OF THE INVENTION

The old axiom of "Practice Makes Perfect" is not completely true. "Perfect Practice Makes Perfect" is the whole truth. It is of ultimate importance that a golfer practice with purpose and precision, and that guesswork is eliminated for line of sight, for body alignment and for ball position.

In accordance with a first aspect of the present invention, there is provided an instructional golf mat beneficially marked on its playing surface with a foot placement grid conveniently formed by intersecting horizontal and vertical alignment lines, at least one sight or target line, and a plurality of ball position lines that provide an expansive selection of precise, reproducible ball positions. Furthermore, the playing surface of the inventive golf mat is beneficially provided with at least one area that simulates a fairway, in other words, with at least one clear hitting area.

In accordance with a second aspect of the present invention, there is provided an instructional and diagnostic golf pattern. The inventive pattern likewise includes a foot placement grid conveniently formed by intersecting horizontal and vertical alignment lines, at least one sight or target line, and a plurality of ball position lines that provide an expansive selection of precise, reproducible ball positions. Furthermore, the pattern is beneficially provided with at least one area that simulates a fairway, in other words, with at least one clear hitting area. The inventive pattern may be variously displayed, for instance, on the playing surface of a golf is mat or on the turf.

Advantageously, the inventive foot placement grid has an open look. For purposes of this description, the term "open look" as used herein is meant to distinguish over the prior art foot placement grids of Dionne et al, Bott, Bishop and Buffey. Those grids include tightly spaced grid lines that appear to form squares, as a result of which a typical golfer's shoe will overlay many squares, for example, Bott's foot silhouette is shown to cover approximately 30 squares. Thus, those grids display too many grid squares relative to a typical golfer's shoe size.

Advantageously, the inventive golf mat or pattern is provided with a plurality of sight or target lines defined by a first set of parallel line segments separated from a second set of parallel line segments by the clear hitting area, and located generally opposite from one another. Beneficially, the inventive golf pattern or mat has a first set of ball position lines located generally opposite from a second set of ball position lines, and the clear hitting area provides separation between the first set and second set of ball position lines. Advantageously, an appropriate ball position line selected from the first set of ball position lines may be used to locate a golf ball in the same precise location relative to the vertical alignment lines of the foot placement grid as the respective corresponding ball position line of the second set.

Additional advantages and beneficial features of the present invention are set forth in the drawing and detailed description, and in part will become apparent to those skilled in the art upon examination of the drawing and detailed description or may be learned by practice of the invention. In the drawing and detailed description, there are shown and essentially described only preferred embodiments of this invention, simply by way of illustration of the best mode contemplated of carrying out this invention. As will be realized, this invention is capable of other and different embodiments, and its several details are capable of modification in various respects, all without departing from the invention. Accordingly, the drawing and the detailed description are to be regarded as illustrative in nature, and not as restrictive.

BRIEF DESCRIPTION OF THE DRAWING

Reference is now made to the accompanying drawing which forms a part of the specification of the present invention.

DETAILED DESCRIPTION OF THE INVENTION

Figure 1:
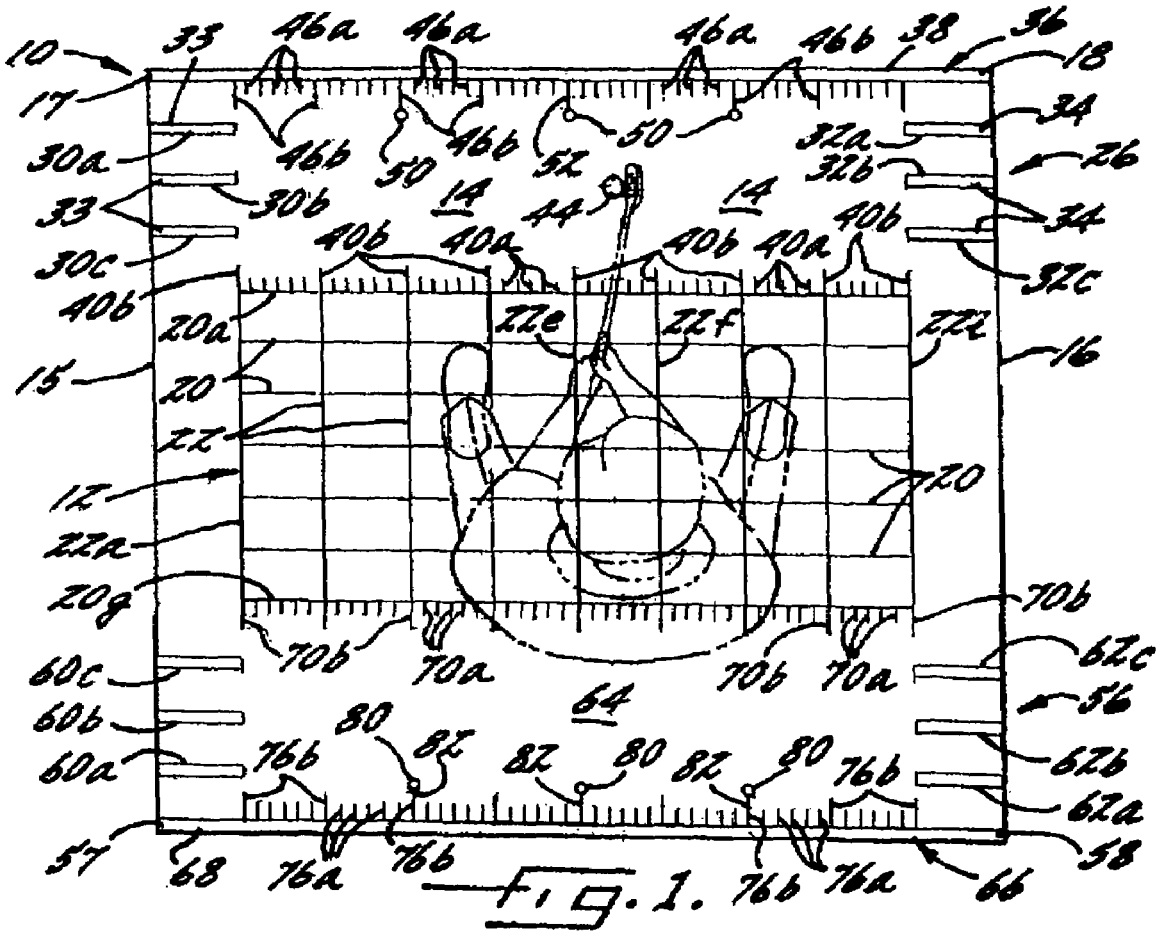
FIG. 1 is a top view of a preferred embodiment of a golf mat in accordance with the invention, which illustrates a golfer having his shoulders, hips and feet parallel to the mat sight lines in a perfectly square stance in which the ball is exactly in the middle of the stance, with the golfer using an iron.

In accordance with the present invention, there are provided an instructional golf mat and pattern that serve the needs of the first time ever beginner to the world's greatest golfers. Beneficially, golfers using the mat and pattern can practice with purpose and precision, and be instructed precisely, and can develop the techniques that are used to hit the ball in the desired manner. In this way, each golfer can master a repetitious swing that is the perfect golf swing for him and that becomes a matter of feel. Repetition develops muscle memory and allows the golfer to finally trust his swing to feel.

As mentioned, the golf mats and patterns described herein, are preferred embodiments. These mats and patterns can vary in size, and thus dimensions of certain features given in the description, can vary. In any event, useful mats include 5'×5', 4'×5', 4'×4', 3'4', and 3'×5' mat sizes. In the description of the invention, relative terms such as "horizontal", "vertical", "top", "lower" and the like have been used particularly with reference to the drawing to assist understanding.

Figure 2:
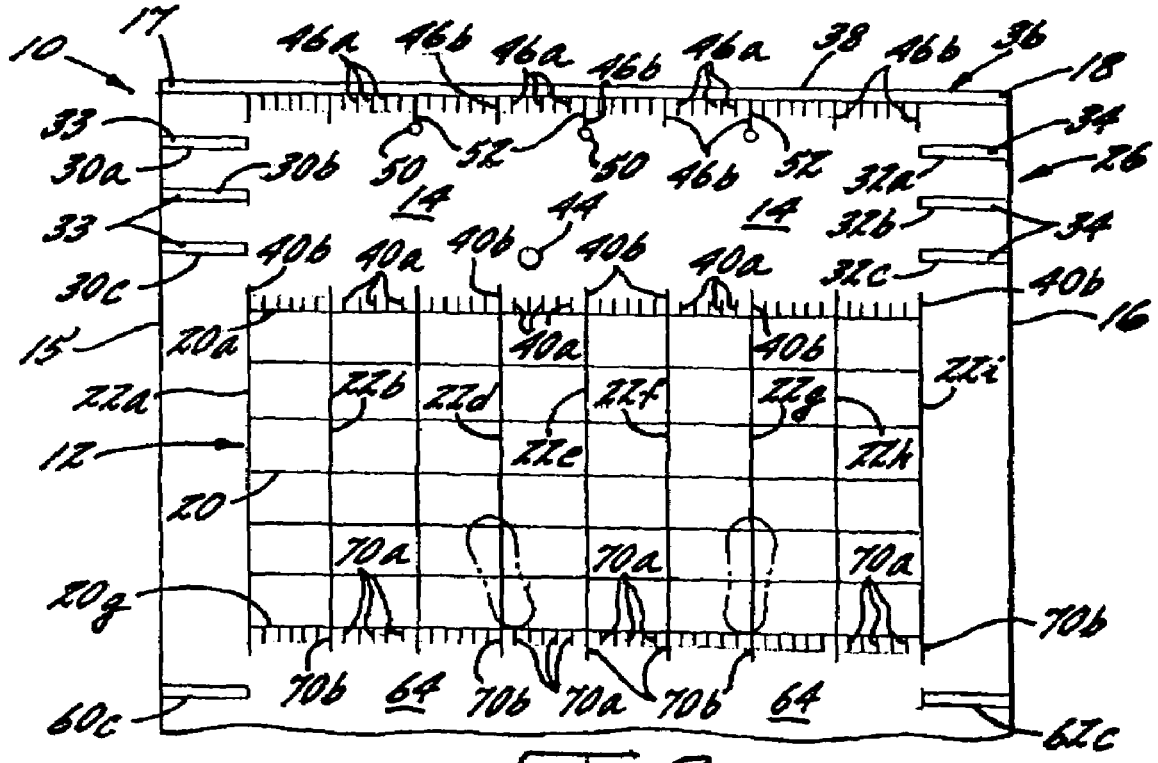
FIG. 2 is a partial top view of the golf mat of FIG. 1, illustrating beneficial ball placement and, in phantom, beneficial foot placement, when using a long wood.

With reference to FIGS. 1 and 2 of the drawing, the playing surface of a golf mat 10 in accordance with the invention, beneficially includes a generally centrally-located, foot placement grid 12 having an open look, and clear hitting areas 14,64, which are unlined areas, near the grid. The foot placement grid is conveniently formed by a plurality of parallel horizontal alignment lines 20 that intersect a plurality of parallel vertical alignment lines 22. Unlined areas 14,64 each simulate a fairway.

Golf is about angles and the laws of physics. A golf mat and pattern in accordance with the present invention take away guess work about proper foot position and beneficially provide for precise, reproducible foot placement and alignment without needless clutter. Accordingly, horizontal alignment lines 20 are advantageously spaced apart from one another and vertical alignment lines 22 are advantageously spaced apart from one another to form a grid with an open look, so as to assist precise and reproducible placement and alignment of the golfer's feet and easy recall thereof. Thus, the width of the grid spaces, that is, the distance between vertical alignment lines 22, may, as shown, beneficially be greater than the width of a typical golfer's shoe. However, if desired, an open look in accordance with the invention, can be maintained, with more closely spaced vertical lines, for example, the spacing could be about half that shown. By comparison, the foot placement grids of the prior art golf mats previously discussed, do not have an open look, but rather have tightly spaced, grid spaces.

Furthermore, the grid spaces formed by alignment lines 20,22 may advantageously be rectangular, with more distance between vertical lines 22 than between horizontal lines 20. In a particularly useful embodiment, a golf mat and pattern in accordance with the invention, include a grid with an open look and rectangular grid spaces, with an about 3:2 width (spacing between grid lines 22) to length (spacing between grid lines 20) ratio beneficially used.

By comparison, the grids of the prior art mats previously discussed, appear to have square spaces. With continued reference to FIGS. 1 and 2, golf mat 10 beneficially includes a plurality of sight lines to sight a target and align the mat with a target. For this purpose, an end 26 of mat 10 is marked with a set of parallel line segments 30*a*,30*b*,30*c* separated from a set of parallel line segments 32*a*,32*b*,32*c* by clear hitting area 14, and located generally opposite to one another near mat corners 17,18. Conveniently, line segment ends 33,34 touch mat side edges 15,16.

Line segments 30*a*,32*a* and line segments 30*b*,32*b* is and line segments 30*c*,32*c* each define a line of sight, and together with a sight line 36, which is the sight line furthest from grid 12, define a plurality of parallel, spaced apart sight lines. The sight lines defined by line segments 30,32 pass through clear hitting area 14, and as will become understood, it is advantageous that the portions of these sight lines passing through the clear hitting area, are substantially between the hereafter-described ball position lines 40,46. Sight line 36 conveniently is marked on a top edge 38 of mat end 26, and runs the entire length of the mat edge.

In accordance with the invention, these sight lines are beneficially parallel to horizontal grid lines 20 and perpendicular to vertical grid lines 22. With reference to FIG. 1 in particular, sight lines located between the golf ball and mat top edge 38, i.e., sight line 36 and the sight line defined by line segments 30*a*,32*a*, assist a golfer in squaring the club face.

It is an objective of this invention that a golfer be able to accurately duplicate the desired golf ball position for every shot; and to achieve this objective, it must be taken into account that the position of the golf ball in a golfer's stance varies among golfers. Furthermore, to hit the ball lower, the ball is further back in the stance, whereas high trajectory shots are played with the ball forward in the stance. The ball is also moved forward or backward depending upon the club used. It is necessary that each golfer find the optimum ball position for his personal swing. To this end, mat end 26 is advantageously provided with ball position lines 40,46, which, as indicated, may beneficially be used with the sight lines to provide an extensive selection of precise, reproducible ball positions.

To assist easy recall of ball placement, it is highly convenient for vertical grid lines 22 to extend past a horizontal grid line 20*a* located closest to clear hitting area 14, and thereby define a portion of a set of ball position lines 40, which conveniently extend from horizontal line 20*a* in the direction of the clear hitting area. In such case, ball position lines 40*b* are extensions of vertical alignment lines 22, and ball position lines 40 are thereby tied to the vertical alignment lines. In addition, it is highly convenient for, as shown, groups of spaced apart relatively shorter ball position lines 40*a* to be between pairs of spaced apart relatively longer ball position lines 40*b*.

If desired, the ends of ball position lines 40 nearer horizontal grid line 20*a* can be spaced from horizontal line

20*a*. Regardless, ball position lines 40 advantageously are perpendicular to horizontal grid line 20*a*.

As can be understood from FIGS. 1 and 2, to benefit precise, reproducible ball placement, ball position lines 40 are closely spaced, whereas vertical grid lines 22 are more widely spaced apart. Furthermore, golf mat 10 is marked with a second set of ball position lines 46 that are spaced apart from ball position lines 40 and conveniently extend from sight line 36 in the direction of clear hitting area 14 and toward ball position lines 40. Like lines 40, to assist easy recall of ball placement, it is highly convenient for, as shown, groups of spaced apart relatively shorter ball position lines 46*a* to be between pairs of spaced apart relatively longer ball position lines 46*b*. In a particularly useful embodiment of a mat or pattern in accordance with the invention, ball position lines 46 are closely spaced, and 1" spacing provides 1" increments between lines 40 and between lines 46.

If desired, the ends of ball position lines 46 nearer sight line 36, can be spaced from sight line 36. Regardless, ball position lines 46 are advantageously is perpendicular to sight line 36.

Ball position lines 46 beneficially correspond in position to ball position lines 40 relative to vertical grid lines 22, such that an appropriate ball position line 46 is useful for locating a ball 44 in the same precise location relative to the vertical grid lines, as the respective corresponding ball position line 40. Thus, if lines 40 were extended through clear hitting area 14, lines 46 would be linear continuations of lines 40. Instead, mat 10 is beneficially provided with clear hitting area 14, and ball position lines 40,46 conveniently extend only a short distance toward one another, in other words, are about 1 to 2 inches in length.

Advantageously, golf mat 10 is provided with a plurality of tee placement apertures 50 appropriately located near mat edge 38 and appropriate spaced apart from one another for tee placement, for instance, about 12" apart. Conveniently, the tee placement apertures touch the tip ends 52 of lines 46*b* located relatively closer to clear hitting area 14. The tee placement apertures are described in further detail with respect to the embodiment of FIGS. 3–5, the pertinent details of which are hereby incorporated into this description of tee placement apertures 50.

With continued reference to FIGS. 1 and 2, golf mat 10 beneficially accommodates left and right handed golfers, or may be rotated 180° for increased wearability and use. Accordingly, a mat end 56 opposite mat end 26, beneficially includes sight lines and ball position lines like those previously described.

As indicated, mat end 56, like mat end 26, beneficially is marked with a set of parallel line segments 60*a*,60*b*,60*c* separated from a set of parallel line segments 62*a*,62*b*,62*c* by a clear hitting area 64, and located generally opposite to one another near mat corners 57,58. Conveniently, the ends of these line segments touch mat is side edges 15,16.

Line segments 60*a*,62*a* and line segments 60*b*,62*b* and line segments 60*c*,62*c* each define a line of sight, and together with a sight line 66, which is the sight line furthest from grid 12, define a plurality of parallel, spaced apart lines of sight. As before, these sight lines are beneficially parallel to horizontal grid lines 20 and perpendicular to vertical grid lines 22. Also as before, the sight lines defined by line segments 60,62 pass through clear hitting area 64, and it is advantageous that the portions of these sight lines passing through the clear hitting area, are substantially between the hereafter-described ball position lines 70,76. By comparison, sight line 66 is conveniently marked on a lower edge 68 of mat end 56 and runs the entire length of the lower mat edge.

Golf mat 10 further includes a set of ball position lines 70 that conveniently extend from horizontal line 20*g* in the direction of clear hitting area 64, and a plurality of ball position lines 76 that conveniently extend from sight line 66 in the direction of clear hitting area 64 and toward ball position lines 70. As before, ball position lines 76 beneficially correspond in position to ball position lines 70 relative to vertical grid lines 22, such that an appropriate ball position line 76 is useful for locating a golf ball in the same precise location relative to the vertical grid lines, as the respective corresponding ball position line 70.

Also as before, ball position lines 70,76 conveniently extend only a short distance toward one another, in other words, are about 1 to 2 inches in length; and, to assist easy recall of ball placement, it is highly convenient for groups of spaced apart relatively shorter ball position lines 70*a* to be between pairs of spaced apart relatively longer ball position lines 70*b*, and for groups of spaced apart relatively shorter ball position lines 76*a* to be between pairs of spaced apart relatively longer ball position lines 76*b*. Further details of ball position lines 70,76 may be understood from the earlier description of ball position lines 40,46, to which attention is invited.

Likewise, golf mat 10 beneficially is provided with a second plurality of tee placement apertures 80 appropriately located near mat edge 68, and appropriately spaced apart from one another for tee placement. As shown, the tee placement apertures may conveniently touch the tip ends 82 of ball position lines 76*b* located relatively closer to clear hitting area 64.

A particularly preferred embodiment of golf mat 10 is a mat with overall dimensions of about 5'×5'. For this mat, vertical grid lines 22 are beneficially spaced about 6" apart, and horizontal grid lines 20 are advantageously spaced about 4" apart, thereby providing rectangular grid spaces having a 3:2 width to length ratio. Furthermore, for this mat, it is suitable for relatively shorter ball position lines 40*a*,46*a*, 70*a*,76*a* to be about 1" long, for relatively longer ball position lines 40*b*,46*b*,70*b*,76*b* to be about 2" long, and for line segments 30,32,60,62 and sight lines 36,66 to be about 1" in width. Moreover, for this mat, it is beneficial for relatively shorter ball position lines 40*a* to be spaced about 1" apart in groups of five between pairs of relatively longer ball position lines 40*b*, for ball position lines 40*b* to be spaced about 6" apart, and for line segments 30*a*,30*b*,30*c* to be spaced about 3" apart from one other. Like spacing may be understood to be advantageous between relatively shorter ball position lines 46*a*, between relatively longer ball position lines 46*b*, between relatively shorter ball position lines 70*a*, between relatively longer ball position lines 70*b*, between relatively shorter ball position lines 76*a*, and between relatively longer ball position lines 76*b*. Furthermore, 3" spacing may be understood to be advantageous between line segments 32*a*,32*b*,32*c*, between line segments 60*a*,60*b*,60*c* and between line segments 62*a*,62*b*,62*c*. Suitably, vertical grid lines 22*a*,22*i* are positioned approximately 6" from the respective mat side edges 15,16.

In use and initially referring to FIG. 1, the golf mat is positioned using the appropriate sight lines to align the mat with a target (not shown), and then a golfer positions his feet on mat grid 12 using alignment lines 20,22.

FIG. 1 shows a stance in which the shoulders and hips are parallel to the sight lines. The back foot should be square, as shown, and the front foot can be square, as shown, or open as shown in FIG. 2, or closed (not shown). The golfer positions his feet relatively forward (FIG. 1) or backward (FIG. 2) on the mat grid, depending upon the club selected (iron, FIG. 1; long wood, FIG. 2) and the ball position. With the open look provided by grid alignment lines 20,22, the golfer can achieve precise, reproducible foot positioning and alignment, and otherwise see for certain if he is using a correct stance.

With continued reference to golf mat 10 of FIGS. 1 and 2, to precisely reproduce a desired golf ball position, the golfer can use appropriate ball position lines 40,46, and also an appropriate sight line: FIG. 1—the appropriate sight line is defined by line segments 30*b*,32*b*; FIG. 2—the appropriate sight line is defined by line segments 30*a*,32*a*. Thus, the plurality of spaced apart, parallel sight lines can assist precise, reproducible positioning of the ball. Furthermore, in a particularly useful embodiment of a golf mat or pattern in accordance with the present invention, the ball position lines are spaced about 1" apart.

Thus, a golf mat or pattern in accordance with the invention allows a golfer to be 100% sure of his set-up is for each shot. The golfer can precisely repeat his foot position and ball position for every practice swing. After repetitive swings, the golfer is able to determine the proper set-up that will give the maximum desired results.

By accurate repetition using the proper set-up, the golfer develops muscle memory that allows him to finally trust his swing to feel. Furthermore, use of a golf mat in accordance with the invention, allows any golfer an opportunity to clearly see and understand what they are truly feeling.

Figure 3:
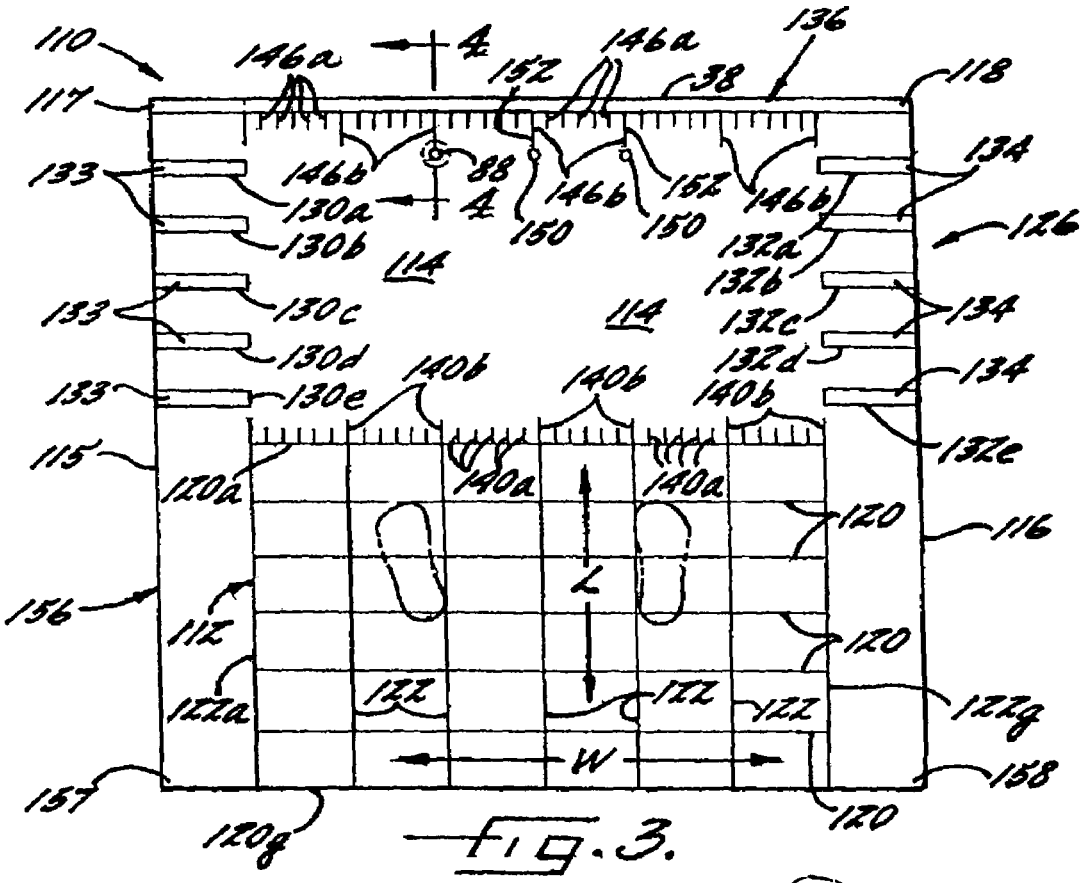
FIG. 3 is a top view of a second preferred embodiment of a golf mat in accordance with the present invention, which indicates the ball on a tee, and in phantom, foot placement for a slightly open stance.
Figure 4:
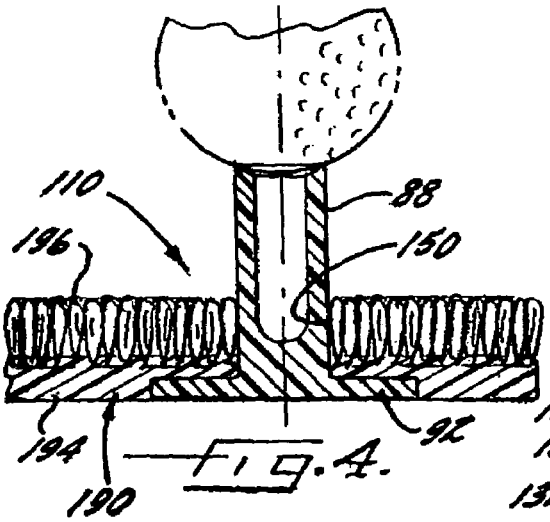
FIG. 4 is a cross-sectional view taken substantially through a line 4—4 of FIG. 3.
Figure 5:
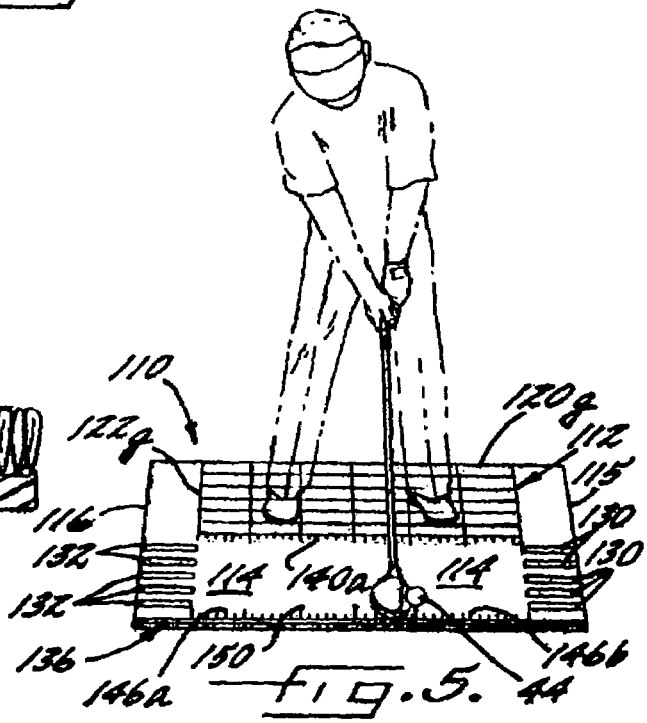
FIG. 5 is a perspective view of the golf mat of FIG. 3, illustrating a golfer playing the ball off the left heel with the slightly open stance and tee placement indicated in FIG. 3, and using a driver.

With reference to FIGS. 3 to 5 of the drawing, a second preferred embodiment of the present invention is illustrated. Golf mat 110 differs from golf mat 10 in that a foot placement grid 112 of mat 110 is located on a lower mat end 156, rather than being generally centrally located, and in that mat 110 lacks a clear hitting area on lower mat end 156 and thus is provided with only clear hitting area 114. Furthermore, clear hitting area 114 is relatively longer (length direction indicated by "L", width direction indicated by "W" in FIG. 3; for purposes of the description, the length and width directions are the same for golf mat 10) than clear hitting area 14 of mat 10, and additional line segments 130*d*,130*e* and 132*d*,132*e* are provided for defining additional sight lines. Other differences include tee apertures 150 spaced from tip ends 152 of ball position lines 146*b*, and tee apertures 150 spaced closer together than tee apertures 50. For sake of brevity in the description of golf mat 110, corresponding 100 series numbering has been used in FIGS. 3–5 for like parts of golf mat 110. It is thus intended that reference can be made to the earlier description relative to golf mat 10.

With reference now particularly to FIG. 4, a tee 88, suitably of rubber, is shown. Conveniently, the tee is inserted from a mat underside 190 opposite the mat playing area through selected tee aperture 150, and a foot 92 of the tee is positioned against the mat underside.

A particularly preferred embodiment of golf mat 110 is a mat with overall dimensions of about 4'×4'. For this mat, as for golf mat 10, vertical grid lines 122 are beneficially spaced about 6" apart, and horizontal grid lines 120 are advantageously spaced about 4" apart. Also as before, in the particularly useful embodiment, ball position lines 140*a* are about 1" long and spaced about 1" apart in groups of five between pairs of ball position lines 140*b*, and ball position lines 140*b* are about 2" long and spaced about 6" apart.

FIG. 4 also illustrates that a typically useful mat may have a rubber or rubber-like lower layer 194 with a turf-simulating upper layer 196, for instance, a knitted nylon playing surface, bonded or otherwise attached. Numerous commercially available golf mats can be suitably used to produce a golf mat in accordance with the present invention, and these include commercially available mats having, for instance, a high density foam lower layer. True ball flight and spin, shock absorption capability, durability, feel and comfort, and price are important considerations for selection of an appropriate commercially available mat for producing a golf mat in accordance with the present invention.

Figure 6:
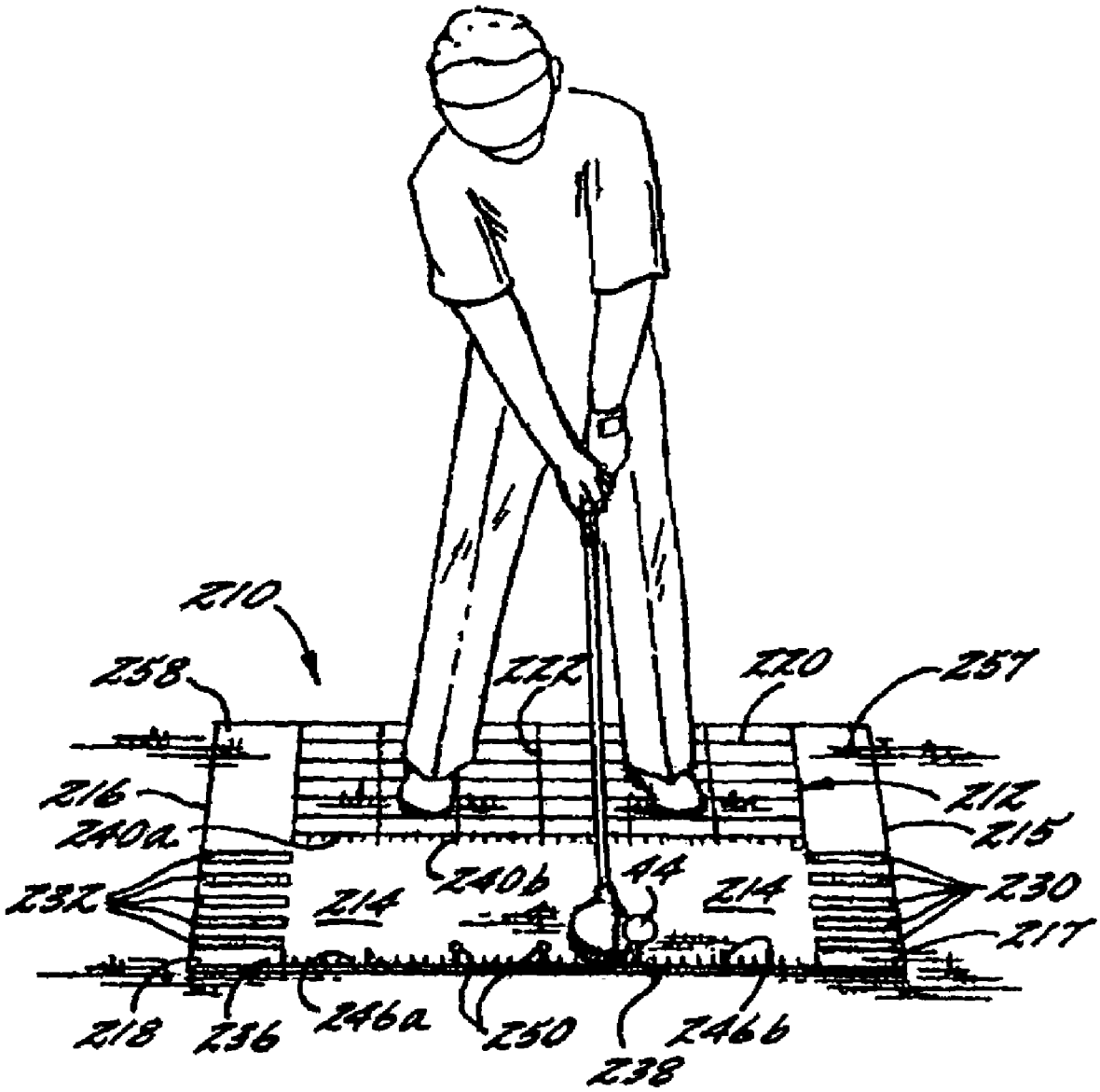
FIG. 6 is a view like FIG. 5, of the golf mat pattern of FIG. 3 displayed on the turf.

With reference to FIG. 6, an instructional golf pattern 210 in accordance with the present invention, is illustrated displayed on the turf. For simplification of the description, instructional pattern 210 corresponds to the pattern displayed on golf mat 110. However, it will be readily recognized that other instructional patterns in accordance with the present invention, can be displayed in place of pattern 210. Furthermore, for sake of brevity in the description, corresponding 200 series numbering has been used in FIG. 6 for parts like the parts of the pattern is of golf mat 110. Thus, instructional golf pattern 210 includes a foot placement grid pattern 212, a set of parallel line segments 230 separated from a set of parallel line segments 232 by a clear hitting area 214, a sight line 236, ball position lines 240,246, and tee placement marks 250.

It will be readily recognized that pattern 210 could be modified, if desired, by, for example, removing side edge lines 215,216. A suitable method of displaying an instructional pattern in accordance with the present invention, on a mat or on turf may use a water-based paint or water soluble paint, as desired or appropriate. An appropriate stencil (not shown) may be used.

The present invention may be carried out with various modifications without departing from the spirit or essential attributes thereof, and accordingly, reference should be made to the appended claims, rather than to the foregoing specification as indicating the scope of the invention.

The invention claimed is:

1. A golf mat displaying an instructional pattern comprising at least one sight line, a foot placement grid comprising a plurality of spaced apart vertical alignment lines, wherein the vertical alignment lines are spaced further apart from one another than adjacent ball position lines of a first set of ball position lines are spaced apart from one another, and a second set of spaced apart ball position lines, wherein said first set of ball position lines is located generally opposite from said second set of ball position lines, and wherein a gridless ball placement area provides separation between said first set of ball position lines and said second set of ball position lines.

2. The golf mat of claim 1, further comprising a first set of parallel line segments separated from a second set of parallel line segments by said gridless ball placement area, wherein said first set of parallel line segments and said second set of parallel line segments are located generally opposite from one another and between a first edge of said golf mat and said foot placement grid, and cooperate to define a plurality of sight lines.

3. The golf mat of claim 2, wherein said plurality of sight lines is located substantially between said first set of ball position lines and said second set of ball position lines, and said golf mat further comprises at least one additional sight line.

4. The golf mat of claim 1, wherein said first set of ball position lines and said second set of ball position lines are located between a first edge of said golf mat and a horizontal line of said foot placement grid, and are oriented perpendicular to said horizontal line.

5. The golf mat of claim 1, wherein said gridless ball placement area comprises a playing Surface that simulates a fairway.

6. The golf mat of claim 1, wherein said golf mat is marked with indicia that display said instructional pattern.

7. The golf mat of claim 1, wherein ball position lines of said first set of ball position lines are of less length than the vertical alignment lines of said grid, and are equally spaced about one inch apart.

8. The golf mat of claim 1, wherein said foot placement grid comprises rectangular grid spaces.

9. A golf mat displaying an instructional pattern comprising a foot placement grid, a first set of parallel line segments separated from a second set of parallel line segments by a gridless ball placement area, wherein said first set of parallel line segments and said second set of parallel line segments are located generally opposite from one another and between a first edge of said golf mat and said foot placement grid, and cooperate to define a first plurality of sight lines, and a plurality of spaced apart, ball position lines.

10. The golf mat of claim 9, wherein said plurality of spaced apart, ball position lines is provided by a first set of spaced apart ball position lines and a second set of spaced apart ball position lines, wherein said first set of ball position lines is located generally opposite from said second set of ball position lines, and wherein said gridless ball placement area provides separation between said first set of ball position lines and said second set of ball position lines.

11. The golf mat of claim 9, further comprising a third set of parallel line segments separated from a fourth set of parallel line segments by a second gridless ball placement area, wherein said third set of parallel line segments and said fourth set of parallel line segments are located generally opposite from one another and between a second edge of said golf mat and said foot placement grid, and cooperate to define a second plurality of sight lines, and said golf mat further comprises at least one additional sight line.

12. The golf mat of claim 9, wherein said plurality of spaced apart, ball position lines is provided by a first set of spaced apart ball position lines and a second set of spaced apart ball position lines, wherein said first plurality of sight lines is located substantially between said first set of ball position lines and said second set of ball position lines, and wherein said golf mat further comprises at least one additional sight line.

13. The golf mat of claim 9, wherein ball position lines of said plurality of spaced apart, ball position lines are of less length than vertical alignment lines of said grid, and are equally spaced about one inch apart.

14. The golf mat of claim 9, wherein said foot placement grid comprises rectangular grid spaces.

15. An instructional golf pattern comprising at least one sight line, a foot placement grid comprising a plurality of spaced apart vertical alignment lines, wherein the vertical alignment lines are spaced further apart from one another than adjacent ball position lines of a first set of ball position lines are spaced apart from one another, and a second set of spaced apart ball position lines, wherein said first set of ball position lines is located generally opposite from said second set of ball position lines, and wherein a gridless ball placement area provides separation between said first set of ball position lines and said second set of ball position lines.

16. The pattern of claim 15, further comprising a first set of parallel line segments separated from a second set of parallel line segments by said gridless ball placement area, wherein said first set of parallel line segments and said second set of parallel line segments are located generally opposite from one another and cooperate to define a plurality of sight lines.

17. The pattern of claim 16, wherein said plurality of sight lines is located substantially between said first set of ball position lines and said second set of ball position lines.

18. The pattern of claim 15, wherein said pattern is displayed on turf.

19. The pattern of claim 15, wherein said foot placement grid comprises rectangular grid spaces.

20. The pattern of claim 15, wherein ball position lines of said first set of ball position lines are oriented parallel to the vertical alignment lines of said grid, and are equally spaced about one inch apart.

21. An instructional golf pattern comprising a foot placement grid, ball position lines of less length than vertical alignment lines of said foot placement grid, and a first of parallel line segments separated from a second set of parallel line segments by a gridless ball placement area, wherein said first set of parallel line segments and said second set of parallel line segments are located generally opposite from one another and cooperate to define a first plurality of sight lines, and said first plurality of sight lines is located substantially between a first set of said ball position lines and a second set of said ball position lines.

22. The pattern of claim 21, wherein said foot placement grid comprises rectangular grid spaces.

23. The pattern of claim 21, further comprising at least one additional sight line.

* * * * *